United States Patent [19]

Brieger

[11] 4,287,946

[45] Sep. 8, 1981

[54] FORMATION TESTERS

[76] Inventor: Emmet F. Brieger, Bonito Rte., Nogal, N. Mex. 88341

[21] Appl. No.: 65,166

[22] Filed: Aug. 9, 1979

Related U.S. Application Data

[62] Division of Ser. No. 908,579, May 22, 1978, Pat. No. 4,210,018.

[51] Int. Cl.[3] ..... E21B 49/00

[52] U.S. Cl. ..... 166/100; 73/155

[58] Field of Search ..... 166/100; 175/4, 4.52; 73/155

[56] References Cited

U.S. PATENT DOCUMENTS

| | | | |
|---|---|---|---|
| 2,905,247 | 9/1959 | Vestermark | 166/100 |
| 3,338,307 | 8/1967 | Reduine | 166/100 |
| 3,530,933 | 9/1970 | Whitten | 166/100 |
| 3,653,436 | 4/1972 | Anderson et al. | 166/100 |
| 3,782,191 | 1/1974 | Whitten | 73/155 |
| 3,934,468 | 1/1976 | Brieger | 73/155 |
| 3,952,588 | 4/1976 | Whitten | 73/155 |

*Primary Examiner*—James A. Leppink

[57] ABSTRACT

A formation tester apparatus for use in a well bore for multiple testing of pressures of earth formation fluids and the taking of a fluid sample, including pad and shoe means selectively operable for sealingly engaging a well bore. Upon sealing engagement of the pad means with the wall of a well bore, a fluid sample is ingested into an expanding chamber while its pressure is sensed. Upon completion of the pressure test, the pad means is retracted from the wall of a well bore, and the expanding chamber contracts to expel the fluid sample. The pressure test may be repeated any number of times. The expanding chamber includes a piston operated with fluid pressure used to actuate the pad means. A choke delays the application of pressure to the piston until after the pad means seals on the wall of the well bore. When a fluid sample is desired, the fluid pressure used to actuate the pad means is increased to operate a first valve means which connects the pad means of a water cushion sampling chamber. After a fluid sample is collected, the fluid pressure is further increased to operate a second valve means which closes off the sampling chamber. When the formations are unconsolidated a slidable probe in the pad means extends outwardly into the wall and forms a mechanical filter. When the probe retracts the filter is self-cleaning.

13 Claims, 8 Drawing Figures

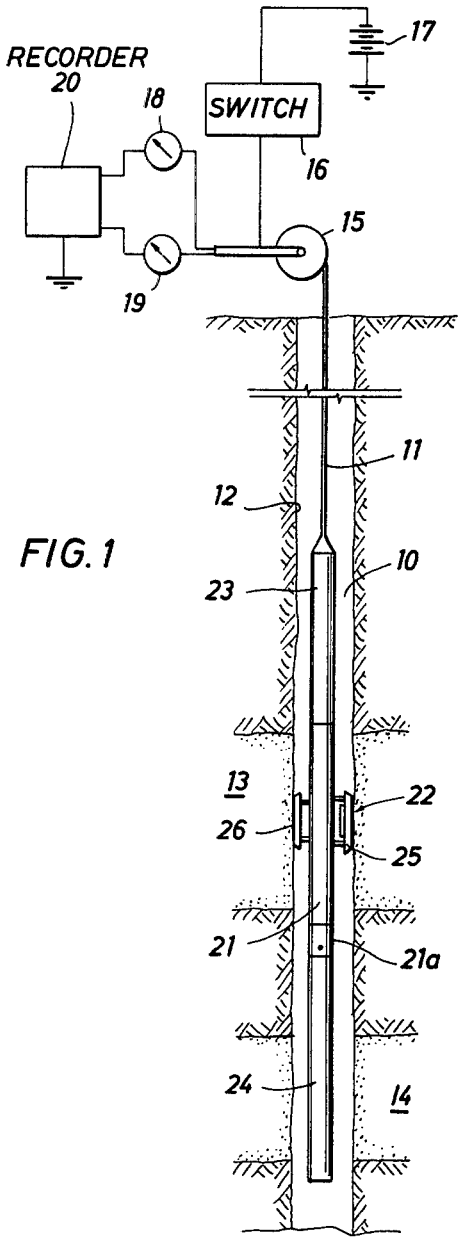
FIG. 1
FIG. 2
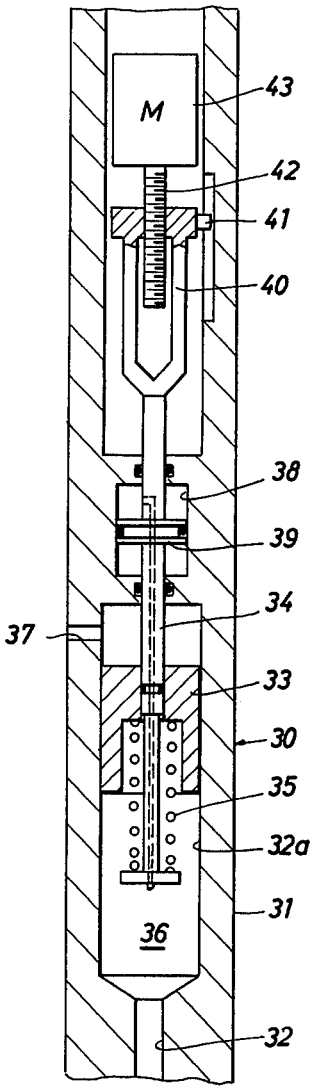

FORMATION TESTERS

This is a division of application Ser. No. 908,579, filed May 22, 1978, now U.S. Pat. No. 4,210,018.

FIELD OF THE INVENTION

This invention relates to improvements in systems for testing fluid pressures in earth formations traversed by a well bore and obtaining fluid samples, and more particularly, to "formation testers" for use in open well bores for performing a number of multiple pressure tests along a well bore, and for obtaining a fluid sample from an earth formation.

DESCRIPTION OF PRIOR ART

The pertinent prior art known is as follows:

(1) U.S. Pat. No. 3,813,936. This patent relates to a formation tester with a probe for use in unconsolidated earth formations and a system for flushing a sand filter in the probe by moving fluid in a reverse direction through the filter to clean the filter prior to obtaining a fluid sample.

(2) U.S. Pat. No. 3,780,575. This patent relates to the apparatus disclosed in U.S. Pat. No. 3,813,936, and relates to a plurality of selectively operable hydraulic valves which operate only at selected pressures.

(3) U.S. Pat. No. 3,782,191. This patent relates to U.S. Pat. No. 3,813,936, and discloses a selectively operable valve with respect to a filtering medium.

(4) U.S. Pat. No. 3,811,321. This patent relates to a formation tester and includes a selectively operable valve means which rapidly opens to a low pressure chamber so as to remove the plugging materials from a filter medium ahead of the flow line before formation fluids are sampled.

(5) U.S. Pat. No. 3,858,445. This formation tester patent relates to use of a compressed gas in the fluid sampling chamber so that a measurement of back pressure provides representative measurement of the rate of sampling.

(6) U.S. Pat. No. 3,859,850. This patent relates to a formation tester which has a structure which involves use of two sampling chambers for sensing back pressure to determine the rate of fluid sampling.

(7) U.S. Pat. No. 3,864,970. This patent relates to formation testers for samping unconsolidated formations with a filter bridging system for collecting loose formation materials to halt erosion from the formation wall.

(8) U.S. Pat. No. 3,924,463. This formation tester patent relates to a filter design system for adjusting the size of the filter to halt erosion of formation fluids.

(9) U.S. Pat. No. 3,859,851. This formation tester patent relates to first and second fluid sampling chambers which are monitored to determine the approximate flow rates of the samples.

(10) U.S. Pat. No. 3,934,468. This formation tester patent relates to a selectively operable probe for use in unconsolidated formations.

(11) U.S. Pat. No. 3,952,558. This formation tester apparatus includes selectively operable, particle collecting means which intake initial mud cake deposits separate from fluid samples to be tested to prevent plugging of the tool.

The foregoing prior art represents a rather complex and interdependent system for deriving fluid samples and fluid pressures. The present invention is intended to provide a simple and straightforward approach to obtaining multiple pressure samples without undue complexity or difficulty and achieve greater reliability in operations.

SUMMARY OF THE PRESENT INVENTION

The present invention involves a formation tester apparatus for use in a well bore for multiple testing of pressures of earth formation fluids and the taking of fluid sample, including pad and shoe means selectively operable for sealingly engaging a well bore. Upon sealing engagement of the pad means with the well bore a fluid sample is ingested into an expanding chamber while its pressure is sensed. Upon completion of the pressure test the pad means is retracted from the wall of the well bore and the expanding chamber contracts to expel the fluid sample. The pressure test may be repeated any number of times. The expanding chamber includes a piston-operated element which is operated with the fluid pressure used to actuate the pad means. A choke delays the application of the fluid pressure to the piston until after the pad means seals on the wall of the well bore. When a fluid sample is desired the fluid pressure used to actuate the pad means is increased to operate a first sample valve means which connects the pad means to a water cushion, sampling chamber. After a fluid sample is collected the fluid pressure is further increased to operate a second seal valve means which closes off the sampling chamber. If the formations are unconsolidated, a slideable probe in the pad means is arranged to extend outwardly into the cavity in the wall and form a mechanical filter when fully extended. When the probe retracts the mechanical filter is self-cleaning. In a further modification, multiple pressure testing at different flow rates can give an indication of permeability.

BRIEF DESCRIPTION OF THE DRAWINGS

The present invention may best be understood when taken in conjunction with the accompanying drawings in which:

FIG. 1 is a schematic view of a formation tester traversing in a well bore traversing earth formations and coupled by an electrical cable to surface controlled equipment;

FIG. 2 is a schematic illustration of a pressure generating system for the hydraulic pressure required to operate the formation tester;

DESCRIPTION OF THE PREFERRED EMBODIMENT

Figure 3:
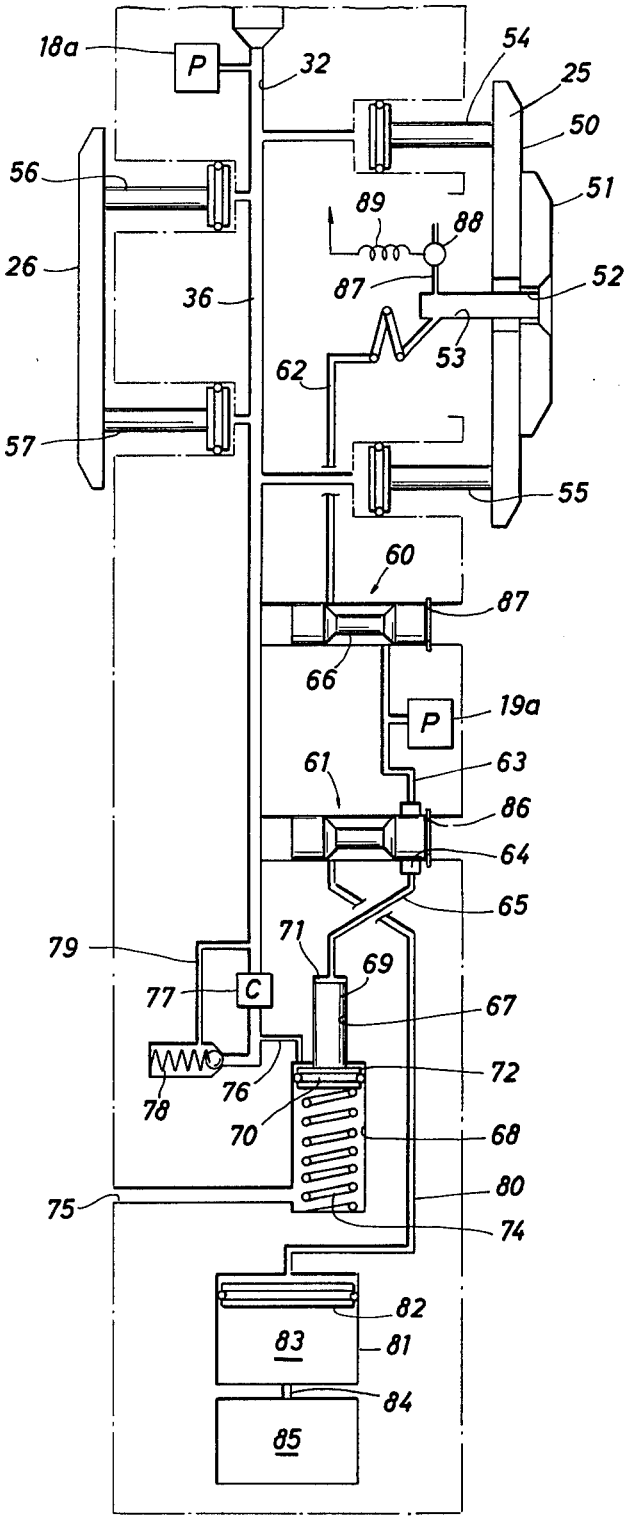
FIG. 3 is a schematic representation of the hydraulic system for actuating the shoe and pad means together with the pressure sampling system and a fluid sampling system.

Turning now to FIG. 1, a formation testing apparatus 10 incorporating the principles of the present invention is shown suspended by a multi-conductor cable 11 in a well bore 12 which traverses one or more earth formations where testing or sampling will be performed. The well cable is carried by a spool and winch 15 at the earth surface and is connected with typical surface equipment including a selectively operable switch means 16, a power source 17, pressure indicating devices 18 and 19 and a recording device 20.

In a preferred embodiment, testing apparatus or the tool 10 includes an elongated body adapted to be passed through a well bore and which is comprised of an actuating section 23, tester sections 21, 21*a* and a fluid sampling section 24. As illustrated, the new and improved apparatus 10 is transportable through a well bore and can be positioned adjacent to a selected formation zone 13 or zone 14 for sampling pressure of the fluids in each of the formation zones and, if desired, for obtaining a fluid sample from a formation zone.

In the use of the present invention, the tool 10 is passed through a well bore filled with a weighted pressure control fluid commonly called "mud". The surface gauges or instruments 18 and 19 provide an indication of the hydrostatic or mud pressure detected by the tool in the well bore while the tool is passed through the well bore. The surface gauge 18 is connected to a first pressure responsive sensor 18*a* in the tester section 21 to indicate pressure of hydraulic fluid in the tester while the surface gauge 19 is connected to a second sensor to measure the pressure of fluids from an earth formation during a test. When the tool is located next to a formation 13 to be tested, the surface switch means 16 is actuated. Actuation of the switch means 16 causes diametrically opposed sampling pad means 25 and a back-up shoe means 26 to be moved outwardly into engagement with the wall of the well bore to the position illustrated in FIG. 1. The general construction and function of the pad means 25 and shoe 26 for this purpose are well known.

In the present invention the pad and shoe means 25, 26 are selectively extendable and retractable relative to the well tool. When the pad means 25 sealingly engages the wall of the well bore, a fluid sample or a fluid pressure may be taken and after the test, the pad and shoe may be retracted to the well tool.

Referring now to the schematic illustration of FIG. 2, the actuating section 23 includes a system 30 for extending and retracting the pad and shoe means. The actuating system 30 includes a housing member 31 with a hydraulic cylinder 32*a* which opens to the hydraulic fluid passage 32. In the cylinder 31 is a piston 33 which is slidably and sealingly received within the cylinder 31 and slidably and sealingly mounted on a piston rod 34. A spring 35 on the piston rod 34 normally urges the piston 33 upwardly into engagement with a shoulder stop on the piston rod 34. The shoulder stop on the piston rod engages the piston 33 to move the piston 33 downwardly to transmit pressure to the hydraulic fluid 36 in the cylinder 32*a* and fluid passage 32. Above the piston 33 the cylinder 31 has a port 37 which opens to the mud fluid in the well bore 12. Thus mud pressure is transmitted to the piston 33 and to the hydraulic fluid 36 independently of the action of the piston rod 34 on the piston.

Above the cylinder 31 is an internal chamber 38 which receives an enlarged piston section 39 on the piston rod 34. Hydraulic fluid 36 from the cylinder 32*a* is admitted to the volume or space above the piston section 39 by means of an internal passageway through the piston rod 34. The volume or space in chamber 38 below the piston section 39 is at atmospheric pressure. Above the chamber 38, the piston rod 34 has an upper adapter 40 which has a nut threadedly receiving a lead screw 42. The adapter 40 is connected by a pin 41 to a vertical guideway in the tool housing. Thus, as the lead screw 42 is turned, the adapter 40 is moved longitudinally of the tool and the piston rod 34 is moved in a vertical direction. The lead screw 42 is driven by an electric, reversible motor 43 which is controlled from the surface controls in switch means 16.

Referring now to FIG. 3, the testing part of the tool is schematically illustrated. In the testing section 21, the pad means 25 includes a metal plate 50 with a curvature to conform to the curvature of the well bore. On the forward face of the pad plate 50 is a resilient sealing pad 51. The sealing pad has a central fluid admitting, tubular passage 53 which is generally inward and transverse to the pad 51. Longitudinally spaced apart piston and piston rods 54, 55 are respectively coupled to the pad plate 50 and are responsive to fluid pressure in the passage 32 and in the well bore to extend or retract the pad plate 50 relative to the section 21. Similarly, the back-up shoe 26 has a curvature about a vertical axis for engaging the wall of the bore hole and longitudinally spaced apart piston and piston rods 56, 57. Pistons 56, 57 are also responsive to fluid pressure in the passage 32 and in the well bore to extend or retract the shoe 26 relative to the section 21.

The fluid passage 32 is connected to a pressure transducer or sensor 18*a* which detects the pressure in the passage 32. The passage 32 also opens to a first seal valve means 60 which can be selectively operated to close the fluid sample chamber and opens to a second sample valve means 61 which can be selectively operated to open the fluid sample chamber. The first and second valve means 60, 61 are shown in FIG. 3 in a position suitable for the taking of multiple samples of pressure. In the position illustrated for the valve means 60, 61, the passage 53 from pad 51 is coupled by a passage 62 to the seal valve means 60. The seal valve means 60 includes a spool valve member 66 which, in the position shown, bypasses fluid through the seal valve means 60 to a passage 63. The passage 63 is coupled to an annular recess 64 about the sample valve means 61 and the recess 64 is coupled to a passage 65 in the pressure test section 21*a*. The passage 65 terminates at the upper end of a bore or cylinder 67. The cylinder 67, in turn, opens to a lower, enlarged bore or cylinder 68. Slidably and sealingly mounted in the cylinders 67, 68 is a stepped piston with a segment 69 in the cylinder 67 and a segment 70 in the cylinder 68. The expandible space 71 above the piston segment 69 is connected by virtue of passage 65, recess 64, passages 63, 62 to the sampling passage 53 in the pad 51. In the passage 63, a pressure transducer 19*a* is coupled to the passage 63 and transmits a measurement of pressure in the passage 63 to the surface controls and gauge 19. The bottom part of the cylinder 68 below the piston segment 70 contains a spring 74 for normally urging the piston segment 70 to its uppermost position and maintaining the space 71 at its smallest volume. Cylinder 68 is also connected by a passage 75 to the mud or fluid pressure in the well bore.

An expandable space 72 located above the piston segment 70 is connected by a passage 76 to a fluid choke 77. The choke 77 connects to the fluid pressure passage 32. The passage 76 is also connected to a one-way valve 78 which is connected by a passage 79 to the fluid pressure passage 32. The one-way valve 78 bypasses the choke 77 and permits return of fluid from the space 72 to the passage 32.

The foregoing system, as constituted, permits multiple testing of pressure. In addition, a fluid sampling passage 80 connects between the normally closed sample valve means 61 and a sampling chamber 81 containing a floating piston 82, a water cushion 83, a choke 84 and an air chamber 85. As will be explained hereinafter, operation of sample valve means 61 opens the sampling chamber 81 and operation of the seal valve means 60 closes the sampling chamber 81.

Figure 4:
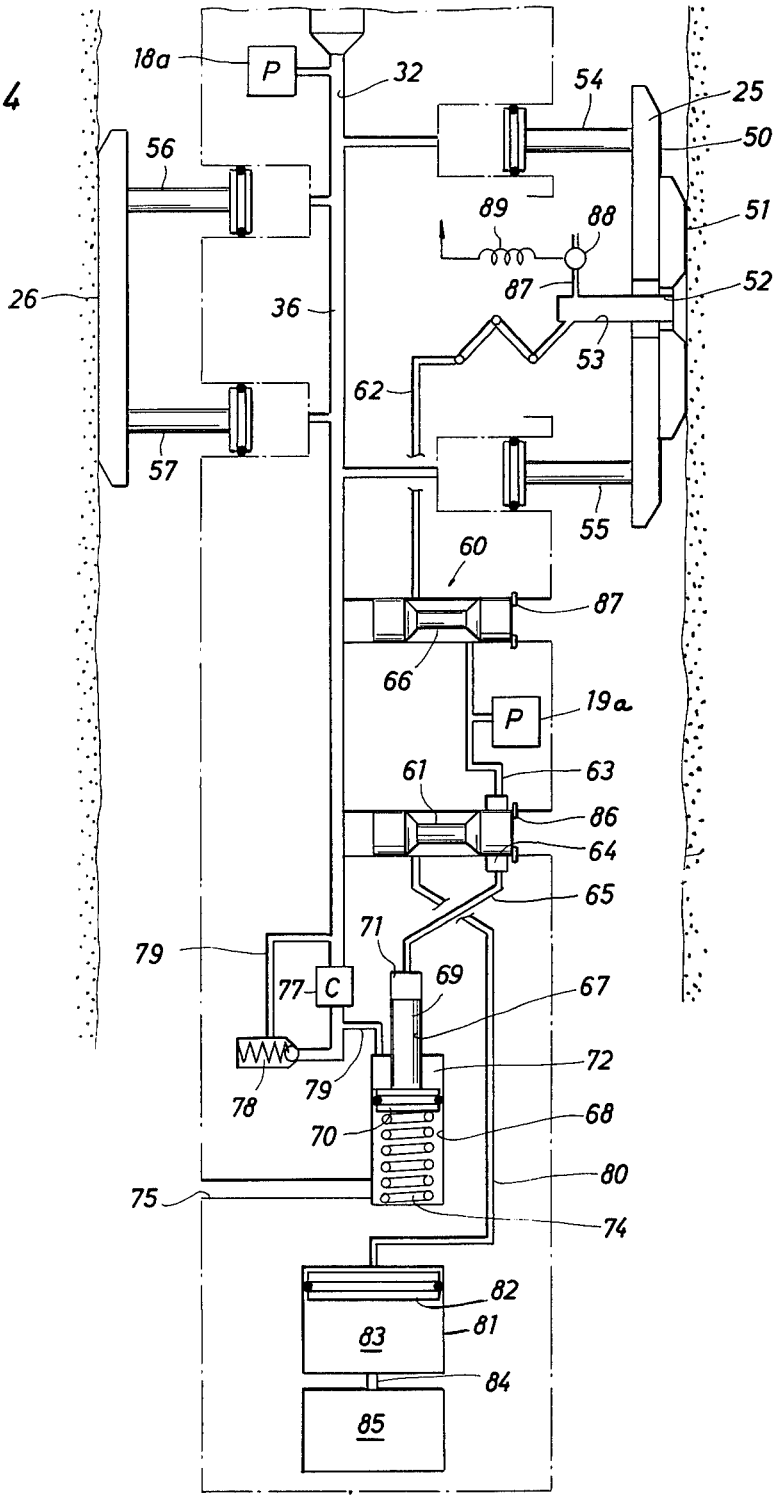
FIG. 4 is a representation similar to FIG. 3 except showing the system in position for taking a pressure sample.

In the condition shown, while going into the well bore, the first pressure sensor **18*a* will detect the hydrostatic mud pressure as the tool goes in the well bore. The second pressure transducer 19*a* will also detect mud pressure prior to the pad and shoe 25, 26 being set against a well bore. To sample the pressure of the fluids in a formation at a given level, the tool is positioned at the desired location and the motor 43 operated to increase the pressure in the hydraulic fluid 36 in the passage 32. As the pressure in passage 32 is increased, the shoe 26 and the pad 25 are moved against the wall of the well bore by virtue of the pressure in the passage 32 acting on the pistons. As hydraulic pressure builds up in the passage 32 after the pad and shoe means engage the wall of the well bore, fluid is slowly passed through the choke member 77 to the passage 76. As shown in FIG. 4, the sealing of the pad 51 against the wall of the borehole permits a fluid pressure to drive the piston segment 70 downward and compresses the spring 74 so that a small fluid sample from the formation is received in the expanding space 71 above the piston segment 69. The pressure of the fluid sample in the expandable space above piston segment 69 is detected by the pressure sensing device 19*a*. If a fluid sample is not desired, the motor 43 is reversed thereby releasing the hydraulic pressure of the fluid 36 in passage 32 and the spring 74 provides a force to move the fluid pressure sample from the space 71 above the piston segment 69 while returning the hydraulic fluid via the bypass check valve 78 into the passage 32 of the hydraulic system. When the piston segment 69** is returned to its initial condition it is prepared to receive another sample for purposes of testing pressure. Thus, the tool can be moved to any number of locations where the pressure of a formation may be sampled in a similar manner.

When it is desired to take a fluid sample, the hydraulic pressure in passage 32 is increased to a sufficient pressure to shear a shear pin 86 in the sample valve means 61. Shearing of the pin 86 moves a valve member to a position where the passage 63 is placed in fluid communication with the sampling chamber 81 via passage 80. When it is desired to close the sample chamber 81 and entrap a fluid sample, the hydraulic pressure in passage 32 is again increased to shear a shear pin 87 in the seal valve means 60. Shearing of the pin 87 moves a valve member in the seal valve to a position blocking off the passage 63. The valve members in valves 60, 61 are self-locking in the position assumed after shearing of a shear pin. To remove the tool, the hydraulic pressure in passage 32 is released or relieved by operation of motor 43 so that the pad 25 and shoe 26 are retracted from the wall of the well bore. In addition to the foregoing, a small port 87 is connected off of the sampling passage 53 to a normally closed valve 88 which contains an electrical explosive squib 89. Upon energization of the squib 89, the valve 88 is opened and mud pressure is immediately admitted to the sampling passage 53 to balance the pressure across the pad 25, thereby facilitating retraction of the pad system. Squib 89 is used in the event that the pad should stick to the wall of the well bore.

Figure 5:
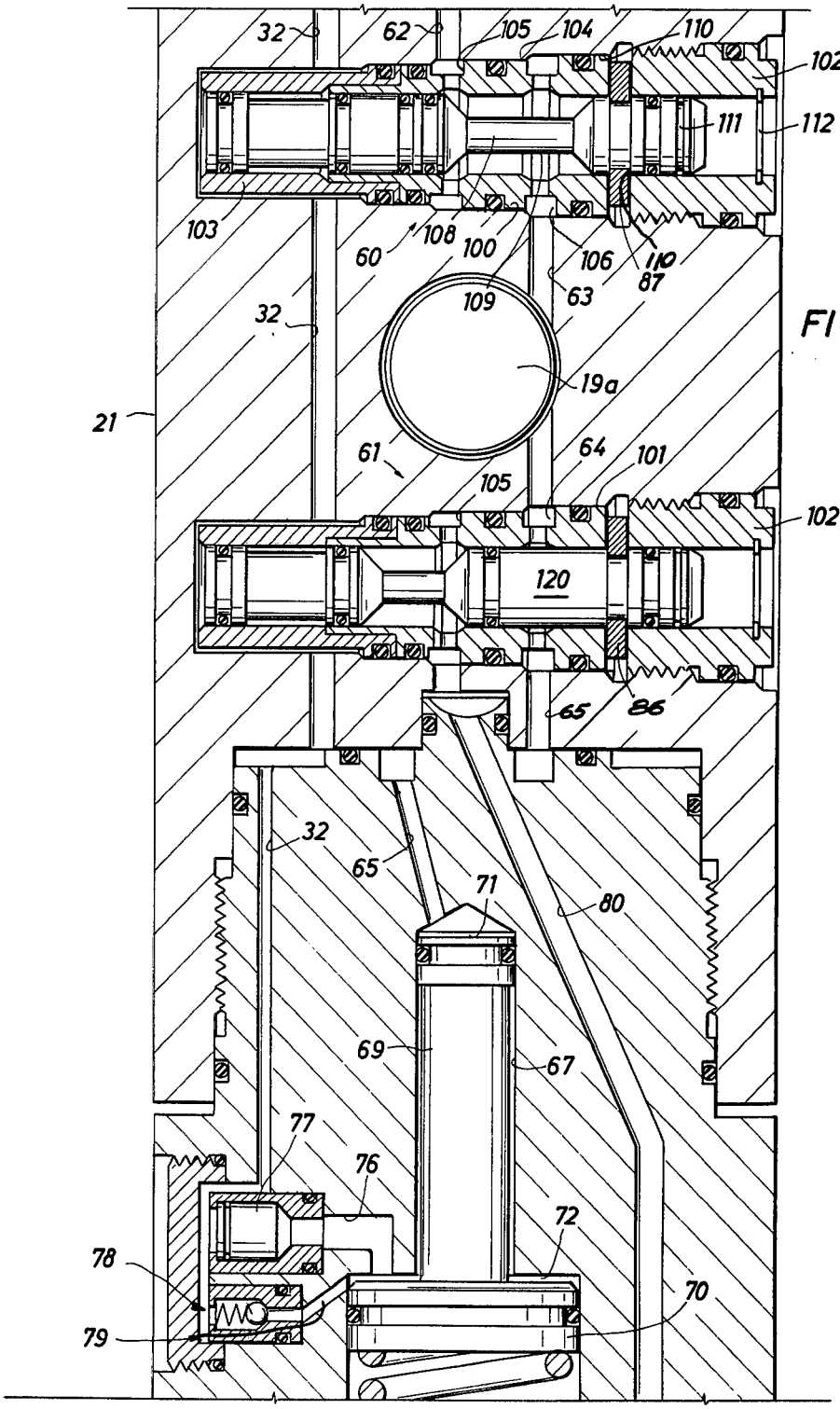
FIG. 5 is a view in cross-section through the tool to illustrate the sample and seal valve means for opening and closing the fluid sample means as well as the structure of the pressure sampling means.

Referring to FIG. 5, specific details of the piston and valve sections are illustrated. The tester section 21 includes a cylindrically shaped housing member which has a first upper transverse bore 100 which receives the first seal valve means 60 and a second, lower transverse bore 101 which receives the second sample valve means 61. The first and second valve means 60, 61 for manufacturing purposes, have some similar or interchangeab parts so that a description of one part will suffice for a general description of the other. In the first seal valve means 60, the transverse bore 100 has bore sections with progressively increasing diameters from the left side of the drawing to the right side of the drawing. A valve stem housing 102 is received in the stepped bore sections together with appropriate O-ring seals and includes a tubular sleeve 103 which has its end spaced from the end surface on the left side of the bore 100 and intersects the vertical fluid passage 32 through the housing. The tubular sleeve 103 is sized relative to the bore 100 and has its lower end spaced from the end wall so that fluid may pass in the annulus about the outer surface of the tubular sleeve thus keeping passage 32 in fluid communication in bypassing valve 60 as well as admitting fluid to the central opening of the tubular sleeve 103. A second tubular sleeve member 104 has one end telescopically received in the first tubular sleeve 103. In the mid-section of sleeve 104 are longitudinally spaced apart annular grooves 105, 106 which are respectively sealed with respect to the bore by O-ring seals. Grooves 105 and 106 are connected by ports to the interior of the sleeve 104. Sleeve 104 is threadedly received in the open end of the transverse bore 100 so that it is fixed with respect to the bore.

Slidably received within the inner bore of the sleeves 103 and 104 is a valve member 108. In the position shown, the valve member 108 has a recessed portion 109 which serves to place grooves 105, 106 in fluid communication in the interior of sleeve 104. O-rings are disposed along the valve member 108 for sealing purposes. Between one set of O-rings on the valve member 108 is an annular groove 110 which is intersected by radial bores in the sleeve 104. Shear pins 87 in the radial bores releasably hold the valve member 108 in an open position.

In the forward part of the valve member 108 is an annular locking groove 111 which is sized to receive a locking ring 112 disposed in the opening of the tubular housing 102. In the position shown, the passageway 62 is coupled by the annular recess 105, 106 to the passageway 63 while the shear pins 87 retain the valve member in position. If the pressure increase in the passageway 32 is sufficient to cause the valve member 108 to shear the shear pins 87 then the valve member 108 will move to the right where the snap ring 112 will engage the groove 111. In this position the annular recess 105 will be disconnected from the passageway 62 by virtue of the O-ring seals. Thus, passage 62 is closed by operation of the seal valve 60.

In the second sample valve means 61, the valve structure is similar but the arrangement of the passageways is somewhat different. For example, the passageway 63 is connected by virtue of the annular recess 64 to other side of the tubular housing 102 and the passageway 80 which opens to the annular recess 105 is normally isolated by the O-rings in the valve member 120. If the pressure is increased to move the valve member 120 to the right and shear the shear pins 86 then the passage 63 and 65 are placed in fluid communication by virtue of the annular recess 64. Passage 63 and 65 interconnect to the top of a cylindrical space 71 which receives the piston segment 69. The passageway 32, as shown, interconnects with one end of a choke member 77 which is a commercially available from the Lee Company. The size of the choke and the viscosity of the fluid are such that the back pressure on the choke is about 2000 p.s.i. The choke member 77 provides a tortuous path for fluid, thereby delaying its movement and opens by virtue of the passage 76 to the top of a cylindrical space 72 which carries the piston segment 70. The remaining structure corresponds generally to the structure as described heretofore in connection with FIGS. 3 and 4.

Figure 6:
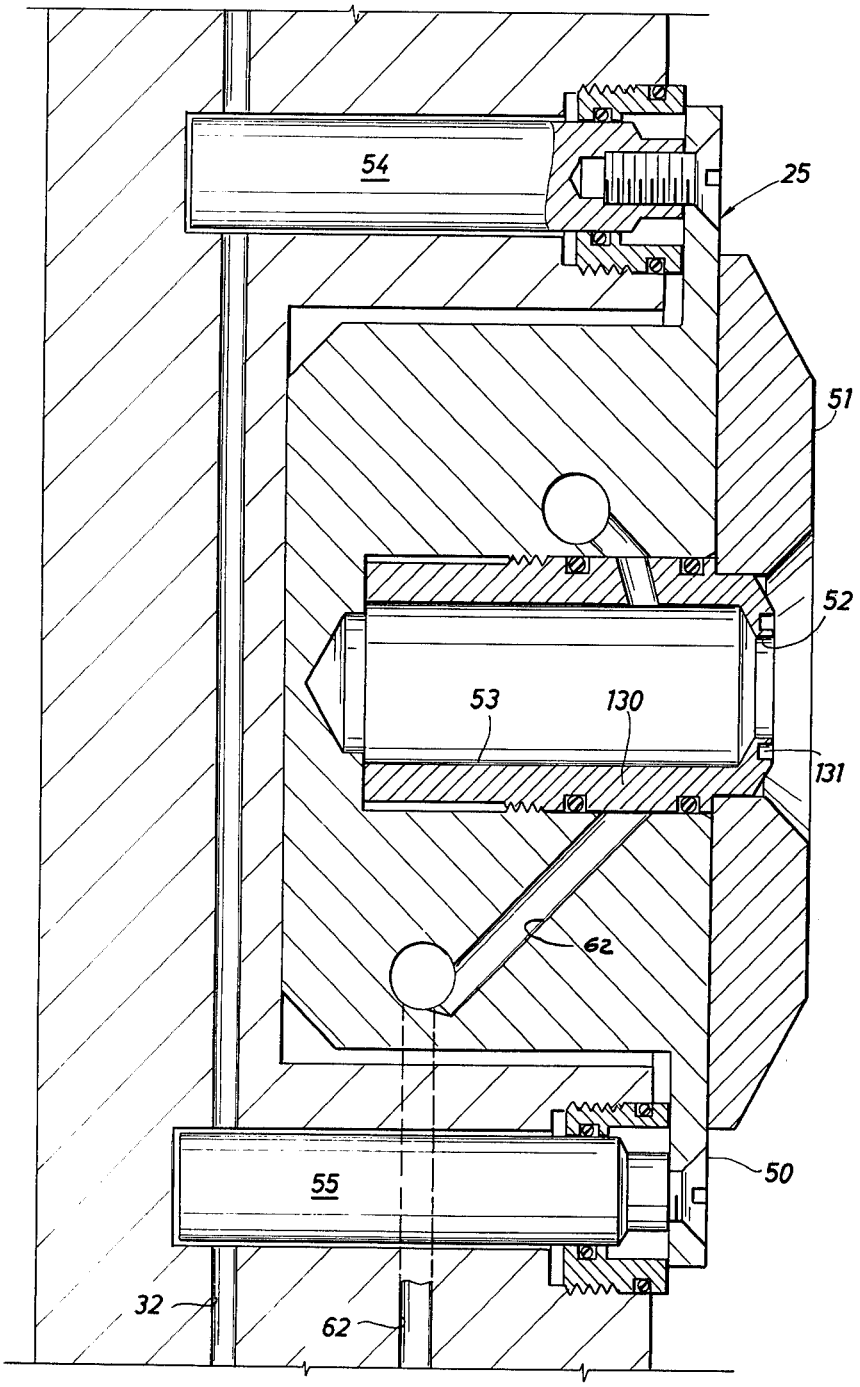
FIG. 6 is a partial view of the portion of the pad means illustrating a sampling probe.

Referring now to FIG. 6, a section of the sealing pad 51 and the housing is illustrated where the resilient member has a central opening which receives over a metal tube 130. The tube 130 is threadably received within the metal block of the pad 25 and has an inwardly tapered, forward portion 52 which is adapted to engage the formation upon compaction of the resilient pad. Where it is anticipated that the formations encountered will be relatively unconsolidated, i.e., that they may well erode when the fluid sample is taken, a different form of the tubular member can be used and is illustrated in FIGS. 7 and 8.

Figure 7:
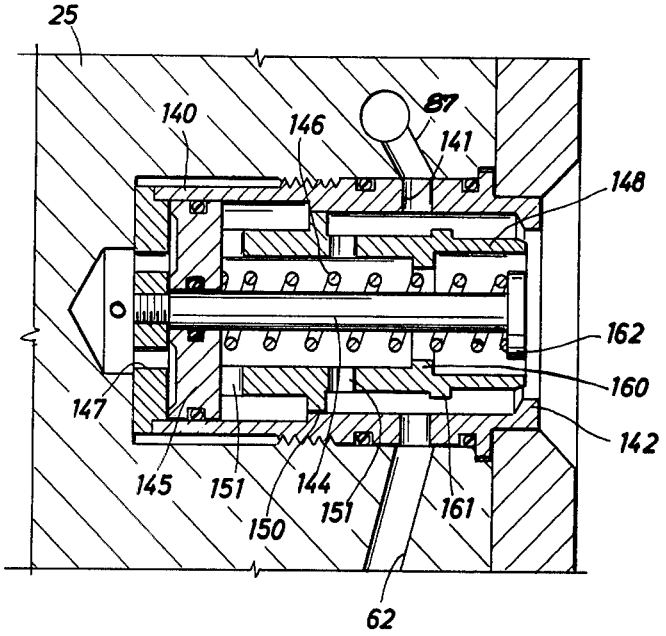
FIG. 7 is a view in cross-section of a modified form of probe for the pad which is shown in a retracted position.
Figure 8:
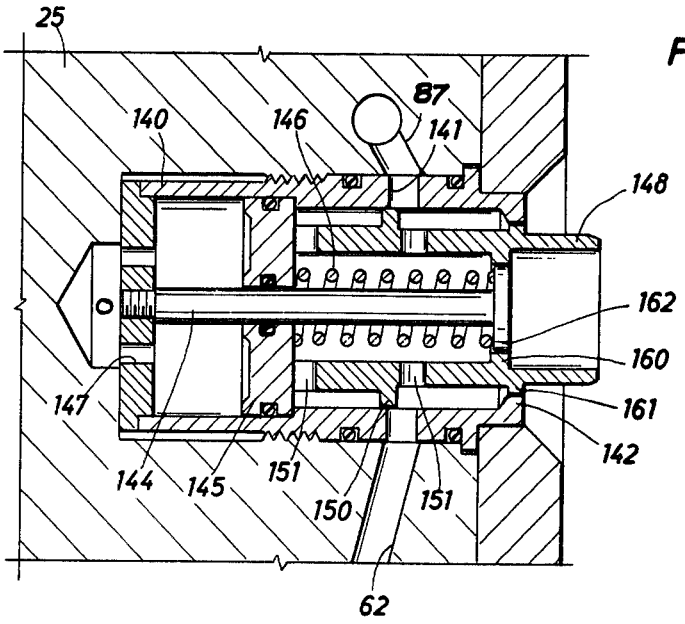
FIG. 8 is a view of the probe shown in FIG. 7 in an extended position relative to an earth formation.

In FIGS. 7 and 8, a cylindrical, tubular member 140 is threadably received within the metal block for the pad 25. Suitable external O-rings are disposed on either side of a sampling port 141 which is in fluid communication with the sampling passage 62. The forward end of the tubular member 140 has an inwardly extending flange 142. Along the central axis of the tubular member 140 is a tubular post 144 on which a piston 145 is slidably and sealably mounted. The piston 145 is engaged on its forward surface by a spring member 146 which is received about the post member and normally urges the piston toward a rearward position in the tubular member 140. The tubular member 140 has openings 147 in its end wall which open to mud in the well bore. Attached to the piston member 145 is a tubular member 148 which has a forward wall section extending through the outwardly extending flange 142. Midway of the length of the tubular member 148 is an outwardly extending, balancing flange 150. Ports 151 are provided in the wall section above and below the flange 150 for the passage of a fluid sample. In the position shown in FIG. 7, the outer surface of the tubular member 148 is spaced from the flange 142 to provide an annular space between the outer wall surface and the inwardly extending flange 142 so that fluid may enter into the chamber and pass through the ports 141 to the passage 62. Should the formation erode or begin to flow into the annular space and into the passage 62, the tubular member 148 will be pressed into the formation by virtue of the mud pressure applied to the piston 145 (via ports 147) and thus maintain contact of the member 148 with the wall. As shown in the extended position of the probe FIG. 8, the piston 145 engages a shoulder within the tubular member and an internal flange 160 on the tubular member 148 is disposed adjacent to the central flange 162 on the post 144 and an outwardly extending flange 161 on the tubular member 148 is disposed adjacent to the flange 142. In this position of the flanges there is an annular spacing between flanges 160, 162 and flanges 161, 142 of about 0.005 inches. The annular clearance space created between the sets of flanges thereby forms a clearance filter for sand particles. This clearance space bridges or retards the sand from flowing in the fluid sample and enhances sample taking.

Upon completion of sampling for pressure or a fluid sample, the spring 146 is used to urge the piston 145 to return to its initial position. When the piston returns to its initial position, the clearance space filters are automatically cleaned because the flanges are moved away from one another, thereby leaving open clearance spaces.

OPERATION FOR MULTIPLE PRESSURE TESTS

The operation of the tool for multiple pressure tests involves positioning the tool at the location where the pressure test is desired. The motor 43 is actuated to move the piston 33 and pressure up the hydraulic fluid 36 in the fluid pressure passage 32. The pressure in fluid passage 32 is sensed by the sensor 18*a* and indicated on gauge 18 while the central passage 53 in the pad is coupled to a pressure sensor 19*a* so that mud pressure is indicated on the pressure guage 19. As the pressure in passageway 32 is increased, the shoe and pad means are sealingly urged against the wall to bring the pad 51 into sealing engagement with the wall of the well bore. The sealing of the pad against the wall of the well bore is indicated by an increase in hydraulic pressure on gauge 18 and, as the pad seals, the fluid pressure in the passage 32 begins to find its way through the delay choke 77 to act on the piston segment 70. If the pad is in sealing engagement with the wall of the well bore, the pressure sensed by the sensor 19*a* will indicate a decline from the mud pressure in the well bore to the pressure in the formations as a fluid sample is ingested in the expanding space 71 above the piston segment 69. The motor 34 is shut off when the hydraulic pressure reaches a value $p_1$ which is a selected pressure value above mud pressure. With the motor off the hydraulic pressure in the passage 32 will decrease as the piston segment 70 continues to move and when the pressure in the fluid passage drops to a second pressure $p_2$ the motor is started up to increase the pressure to the $p_1$ value. In the alternative, the motor 34 can be run very slowly to maintain the pressure constant or slowly varying somewhere between the pressure levels $P_1$ and $P_2$. When the hydraulic pressure in the passage 32 stops decreasing, this is an indication that the piston segment 69 has been moved its full length of travel and has engaged a stop. If at this time the gauge 19 reads a sample pressure of less than mud pressure, this can be taken as the formation shut-in pressure value. The motor 34 is then reversed to relieve the pressure in the passage 32 so that the pad and shoe are unseated from the wall of the well bore and the piston segment 69 is returned to its initial condition by virtue of mud pressure acting through the port 75 and the additional force of the spring 68 acting on piston 70. The hydraulic fluid in the space 72 is returned to the passage 32 via the one-way check valve 78 and bypasses the choke 77. The tool can then be moved to a second location and the above defined pressure test repeated.

This pressure test may be repeated as many times as desired.

Whenever it is desired to obtain fluid sample in the sample chamber, the hydraulic pressure is increased to a $P_3$ value which is greater than the $P_2$ pressure. The $P_3$ pressure value is sufficient to cause the sample valve 61 to shear the pins 86 and move the valve to its second, locked position where a fluid sample is admitted to the fluid sampling means 81. If the sample pressure gauge reading from sensor 19*a* goes to mud pressure soon after opening the sample valve, then the pressure in the passage 32 can be reduced by operation of the motor and the pads retracted so the tool can be moved up or down and reset against the wall bore with the pressure in passage 32 again brought up to the $P_3$ value. After a sufficient time has been taken to gather a fluid sample, the hydraulic pressure in the passage 32 is increased to a $P_4$ value which is greater than the $P_3$ pressure value in order to shear the pins 87 and close the seal valve 60 thereby trapping fluid sample in the sample chamber 81.

OPERATION OF THE PROBE—FIGS. 6 AND 7

When the probe in FIGS. 6 and 7 is used with the formation tester apparatus as disclosed herein, the operation of the tool to set the pad in sealing engagement with the wall of the well bore and pressure sampling is as described before. Where the formations are competent, that is, no sand flows into the tool, the probe does not enter into the formation but will move out only far enough to contact the formation and formation fluids will continue flowing in through the probe during the test. Should the formation be incompetent, i.e., the sand flows into the tool along with formation fluid, then the probe will be moved into the formation as shown in FIG. 8. The probe will enter into the formation due to the differential pressure across the piston portion 140. The forward end of the probe 148 replaces the volume of sand entering the tool, thus making penetration into the formation possible When the piston 140 is stopped on the shoulder, the probe has moved far enough out to block the openings at the flanges except for circular slits which are a few thousandths of an inch wide. These circular slits function similar to a slit sand screen in allowing the fluid to enter but blocking the flow of sand particles. Thus, the rupture of the resilient pad means is eliminated when the sand flow is stopped and the seal can be maintained.

The circular filter formed by the extended probe is cleaned each time the tool is reset because as the tool is released with respect to the wall of the well bore, the differential pressure across the piston 140 is brought to zero and the spring 146 will retract the probe. When the probe is retracted it automatically cleans the openings to full opening by moving the flanges and eliminates the clearance slits so that any plugging that might occur is eliminated. In the use of the probe, if there is filter mud cake on the walls of the well bore it is flushed into the tool before the flow is directed through the cylindrical slits, thereby reducing the possibility of plugging of the slits because of the mud cake.

AN OPERATION OF THE TOOL TO OBTAIN FORMATION PERMEABILITY

Where it is desired to obtain an indication of formation permeability, this can be accomplished with this present invention by putting stops in the sample and seal valves so that they cannot function. Alternatively the shear pin ratings for pins 86, 87 can be increased to a point where they cannot shear under the hydraulic pressure involved. For obtaining an indication of permeability, the tool is set at a first location in the well bore and the motor 34 is actuated up to a first pressure level to seal the pad against the wall of the well bore and maintained at this pressure level. During the time subsequent the sample pressure is measured while the intake chamber 71 opens very slowly because of the delayed fluid passing through the choke 77 to the piston segment 70. The hydraulic pressure in passage 32 is then reduced by reversing the motor 34 so that the pressure is relieved back to low pressure where the intake chamber 71 is dumped. Next, the motor is operated to increase the hydraulic pressure in the passage 32 to a second pressure level which is much greater than the first pressure level so that the intake chamber 71 will open at a faster rate because fluid passes through the choke 77 at a faster rate. The sample pressure is measured as the sample comes in the intake chamber 71 of the tool at the faster rate. Thus, the differential flowing pressures are obtained from one formation at different rates of flow and can be used for a determination relative to permeability of the earth formations.

I claim:

1. A formation tester adapted for passage through a well bore traversing earth formations and comprising:

an elongated tool body adapted for passage through a well bore;

shoe and pad means on said tool body adapted for lateral movement relative to said tool body between a retracted position and an extended position in engagement with the wall of a well bore;

a tubular member slidably disposed in said pad means, said tubular member having an actuating piston which can be placed into access to well pressure thereby to move said tubular member between a retracted position and an extended position, spring means in said pad means normally urging said tubular member toward its retracted position;

said tubular member having a central opening adapted to receive a fluid sample, said pad means and tubular member cooperating when said tubular member is in an extended position to restrict the size of said central opening to form an annular clearance space for bridging sand particles, and when said tubular member is in a retracted position, to provide unrestricted access to said central opening.

2. The apparatus as defined in claim 1 and further including:

a central post member attached to said tool body and disposed within said tubular member, said post member and tubular member having cooperating flanges which define said annular clearance space when said tubular member is in an extended position.

3. The formation tester apparatus as defined in claim 1 and further including means for limiting the movement of said tubular member relative to said pad means in said extended position.

4. A formation tester adapted for passage through a well bore traversing earth formations and comprising;

an elongated tool body adapted for passage through a well bore;

shoe and pad means on said tool body adapted for lateral movement relative to said tool body between a retracted position within said tool body and an extended position in engagement with the wall of a well bore;

probe means on said pad means movable between a retracted position and an extended position relative to said pad means, said probe means including a tubular member having a piston slidably received within said pad means which can be actuated to move said tubular member toward its extended position and retractor means for moving said tubular member and piston toward its retracted position;

means on said tool body for placing said piston into access with well pressure for actuating said tubular member to move toward its extended position;

said pad means and tubular member having cooperating, structure when said tubular member is in an extended position for defining a restricted clearance opening for fluid flow, said clearance opening being sized to inhibit flow of particulate matter thereby providing for bridging of sand particles, said cooperating structure on said pad means and tubular means defining an opening for fluid flow which is sized to pass particulate matter when said tubular member is in a retracted position.

5. The formation tester apparatus as defined in claim 4 and further including:

a central post member attached to said tool body and disposed within said tubular member, said piston being slidingly and sealingly received on said post member, said post member and tubular member having cooperating flanges which define said restricted clearance opening therebetween when said tubular member is in an extended position, said retactor means being a spring member.

6. The formation tester apparatus as defined in claim 5 and further including means for limiting the movement of said tubular member relative to said pad means in the extended and retracted positions.

7. The formation tester as defined in claim 6 and further including sample chamber means in said tool body for receiving a fluid sample, means fluidly coupling said sample chamber means to the interior of said tubular member.

8. A formation tester adapted for passage through a well bore traversing earth formations and comprising:

an elongated tool body adapted for passage through a well bore;

shoe and pad means on said tool body adapted for lateral movement relative to said tool body between a retracted position and an extended position in engagement with the wall of a well bore;

probe means on said pad means including formation probe member movable between an extended position and a retracted position relative to said pad means, said probe means having a piston slidably received in said pad means and retractor means for moving said probe member to a retracted position;

means for placing said piston into access with well pressure for urging said tubular member toward an extended position;

means on said probe member for providing a normal opening for the flow of formation fluids containing sand while said tubular member is in a retracted position and for providing a restricted opening sized to filter sand particles when said probe member is in an extended position for bridging of sand particles at the restricted opening while permitting the taking of a fluid sample.

9. The apparatus as defined in claim 8 wherein said probe means includes a central post member disposed within said probe means;

means on said probe member for cooperating with said central post member for providing said restricted opening sized to filter said particles when said probe member is in an extended position; and said retractor means is a spring member.

10. The formation tester apparatus as defined in claim 9 and further including sample chamber means in said tool body for receiving a fluid sample, and means for placing said sample chamber means into access with said central member.

11. The formation tester apparatus as defined in claim 10 and further including means for limiting movement of said central member relative to said pad means in the extended and retracted positions.

12. A formation tester adapted for passage through a well bore traversing earth formations and comprising:

an elongated tool body adapted for passage through a well bore;

shoe and pad means on said tool body adapted for lateral movement relative to said tool body between a retracted position and an extended position in engagement with the wall of a well bore;

probe means on said pad means including formation probe member movable between an extended position and a retracted position relative to said pad means, said probe means having a piston slidably received in said pad means and retractor means normally urging said probe member to a retracted position;

means on said probe member for providing a normal opening for the flow of formation fluids containing sand while said tubular member is in a retracted position and for providing means for preventing flow of sand while said probe member is in an extended position thereby bridging sand particles and preventing entry into said tubular member while said tubular member is in an extended position.

13. The formation tester apparatus as defined in claim 12 wherein said retractor means is a spiral spring member.

* * * * *